US005399409A

United States Patent [19]

Whiteman

[11] Patent Number: 5,399,409

[45] Date of Patent: Mar. 21, 1995

[54] TACKING DEVICE FOR ATTACHING TO TEXTURED SURFACES

[76] Inventor: Gaylen L. Whiteman, 6017 - 147th Ave. SE., Bellevue, Wash. 98006

[21] Appl. No.: 913,810

[22] Filed: Jul. 16, 1992

[51] Int. Cl.[6] ..... B32B 3/06

[52] U.S. Cl. ..... 428/86; 428/92; 428/95; 428/99; 428/100

[58] Field of Search ..... 428/92, 100, 95, 86, 428/99

[56] References Cited

U.S. PATENT DOCUMENTS

| | | | |
|---|---|---|---|
| 3,128,514 | 4/1964 | Parker et al. | 428/100 |
| 3,370,818 | 2/1968 | Perr | 428/100 |
| 3,453,696 | 7/1969 | Mates | 428/100 |
| 3,679,530 | 7/1972 | Perina | 428/92 |
| 3,726,752 | 4/1973 | Provost | 428/92 |
| 3,817,817 | 6/1974 | Pickens, Jr. et al. | 428/95 |
| 3,849,840 | 11/1974 | Yamada et al. | 428/100 |
| 3,857,397 | 12/1974 | Brosseau | 428/100 |
| 3,885,768 | 5/1975 | Frye | 428/100 |
| 4,180,890 | 1/1980 | Brumlik | 428/86 |
| 4,391,457 | 7/1983 | Gassner | 428/100 |
| 4,403,366 | 9/1983 | Lucke | 428/100 |
| 4,770,917 | 9/1988 | Tochacek et al. | 428/92 |
| 4,959,265 | 9/1990 | Wood et al. | 428/100 |
| 5,200,245 | 4/1993 | Brodrick, Jr. | 428/100 |

*Primary Examiner*—George F. Lesmes
*Assistant Examiner*—Terrel Morris
*Attorney, Agent, or Firm*—David L. Tingey

[57] ABSTRACT

A sheet having one side with a multiplicity of outwardly-extending small, resilient hooks, such as are now commonly employed in "Velcro" styled hook tape for engaging upholstery threads and similar textured surfaces. On the sheet side opposite the hooks is a structural matrix comprised of adhesive interfused among small fibers typically arranged as ribs on the sheet side. Conventional attachment devices, such as hooks or clasps, are attached to the structural matrix to provide a means for attaching a mating object to a textured surface. When adhesive is limited in forming the matrix, the resulting surface presented to the mating object is a plurality of extending, spaced-apart, small contact surfaces which effectively converts the matrix high tack adhesive to a low tack adhesive useful for attaching paper. A low tack adhesive may also be applied over the matrix to directly form a flat, mildly adhesive surface.

5 Claims, 3 Drawing Sheets

TACKING DEVICE FOR ATTACHING TO TEXTURED SURFACES

BACKGROUND OF THE INVENTION

This invention relates to tacking devices, especially to devices for engaging soft, textured surfaces such as upholstery or upholstered walls to facilitate nondestructive attachment of items to such surfaces.

It is well-known that normal tacking devices, such as traditional tacks with sharp spikes and large heads, do not adhere well to soft surfaces, such as upholstered furniture, carpet, or upholstered wall dividers commonly found in offices. While these traditional tacks may hold to the soft surface for a short time, if at all, they soon lose their hold, largely because they require a high frictional resistance to withdrawal from the surface they penetrate. Because fabric and other soft textured surfaces do not provide this frictional resistance, the tacks fall out. Also, when traditional tacks are used to attach objects, such as paper, to a wall, the tack must also penetrate the object, leaving marks and perforations on the paper, leaving an undesireable scar on the paper.

An object of the present invention is to provide a soft-surface tacking device, ("soft tack") that does not rely on significant penetration of an object's surface and high frictional resistance to withdrawal of the device from the object. Specifically, it is the object of the present invention to provide a soft tack that adheres to the surface of a textured, upholstered material, typically woven, rather than penetrate significantly beyond the material surface.

A further object is to use this soft tack in combination with clasping or adherent means such that various and sundry objects can be attached to soft, textured surfaces.

Another object is that the soft tack provide a nondestructive mechanism for removably attaching an object having nominally flat and smooth surfaces, such as paper, foil, or plastic sheets, to soft, textured surfaces without perforating the object.

Yet another object is that the soft tack be reusable.

SUMMARY OF THE INVENTION

In accordance with these objectives, the present invention is directed to a sheet having one side with a multiplicity of outwardly-extending small, resilient hooked fiber, such as are now commonly employed in "Velcro" styled hook tape usually used in combination with a multiplicity of small loops on a companion tape. In this invention, loop tape is not employed, rather the hooks attach themselves to upholstery threads and similar textured surfaces which can be grasped by the small hooks. The sheet further has a textured surface on its side opposite the fiber hooks. High tack adhesive is applied to and melted into the textured surface by applying heat and mild pressure to gently urge the adhesive to interfuse into the coarse texture of the sheet. When the adhesive cools, in addition to any chemical bond formed, a physical bond results from a structural matrix of adhesive interfused into the sheet textured surface.

When a limited amount of high tack adhesive is applied, the resulting structural matrix of adhesive interfused into the sheet textured surface assumes the general, shape of the coarse texture of the sheet. Thus, its general contact surface presented to a comparative large surface of a mating object, such as a sheet of paper, comprises a plurality of small, spaced-apart contact areas covered with adhesive. The reduced contact of the high tack adhesive with the mating object effectively converts the high tack adhesive to a low tack adhesive while retaining the high tack adhesion to the sheet textured surface. In the alternative, a low tack adhesive can be layered over the structural matrix to form generally flat, low-adhesive contact surface presented to the mating object surface.

A conventional attachment device, such as a hook or clamp, can be attached to the structural matrix. The structural matrix contributes added strength which would not be available if an attachment device with adhesive applied would be simply placed over the sheet or conventional hook tape. To increase adhesion to the matrix, additional adhesive may be applied to present a uniform contact surface of adhesive to the attachment device. The additional adhesive may be applied during or after formation of the structural matrix.

Several attachment devices can be combined with the soft tack, and this invention is intended to include all such devices, without limitation in the examples given herein. If the use of the soft tack is to hang paper to a carpeted wall, the reduced contact of high tack adhesive may suffice. Alternatively, a mild adhesive, such as might be found on 3M Post-it TM Notes may be applied to the structural matrix. Typically, the soft tack of this invention thus prepared is first applied to the paper at one or more locations and then with hooks protruding away from the paper, the soft tack is then attached to the upholstered surface with the resilient hooks engaging the surface.

Similarly, if the intended purpose is to establish an open hook on the upholstered surface for general light use, then the attachment device is a light-weight hook. Another attachment device available is a spring-loaded clasp.

BRIEF DESCRIPTION OF THE DRAWINGS

In FIG. 4*a*, the securing element is a hook. In FIG. 4*b*, the securing element is a clasp with a closing jaw. In FIG. 4*c*, the securing element is a mild adhesive.

DESCRIPTION OF THE PREFERRED EMBODIMENTS

Figure 1:
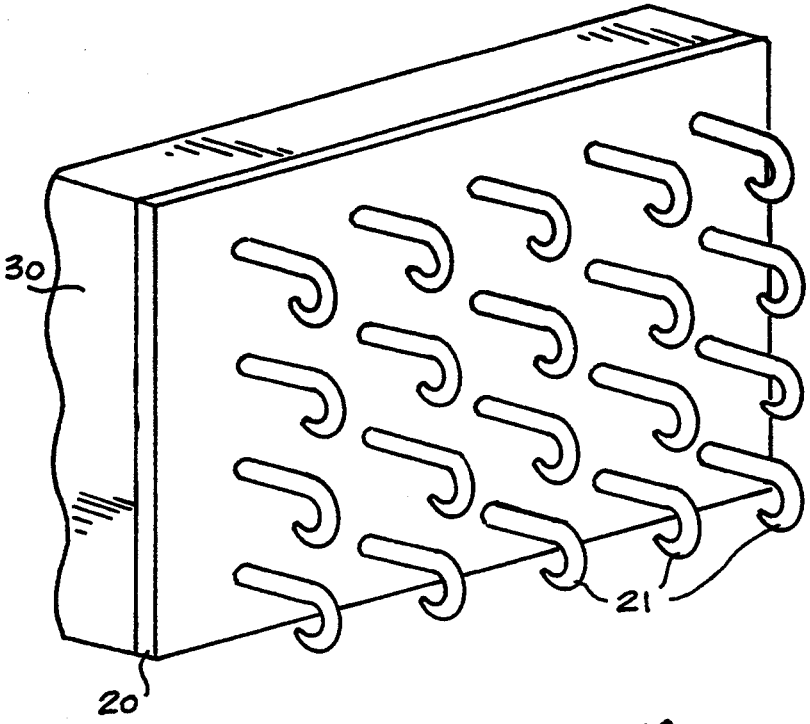
FIG. 1 is a perspective view of a first embodiment of the soft tack showing protruding hooked fibers and a structural matrix.
Figure 2:
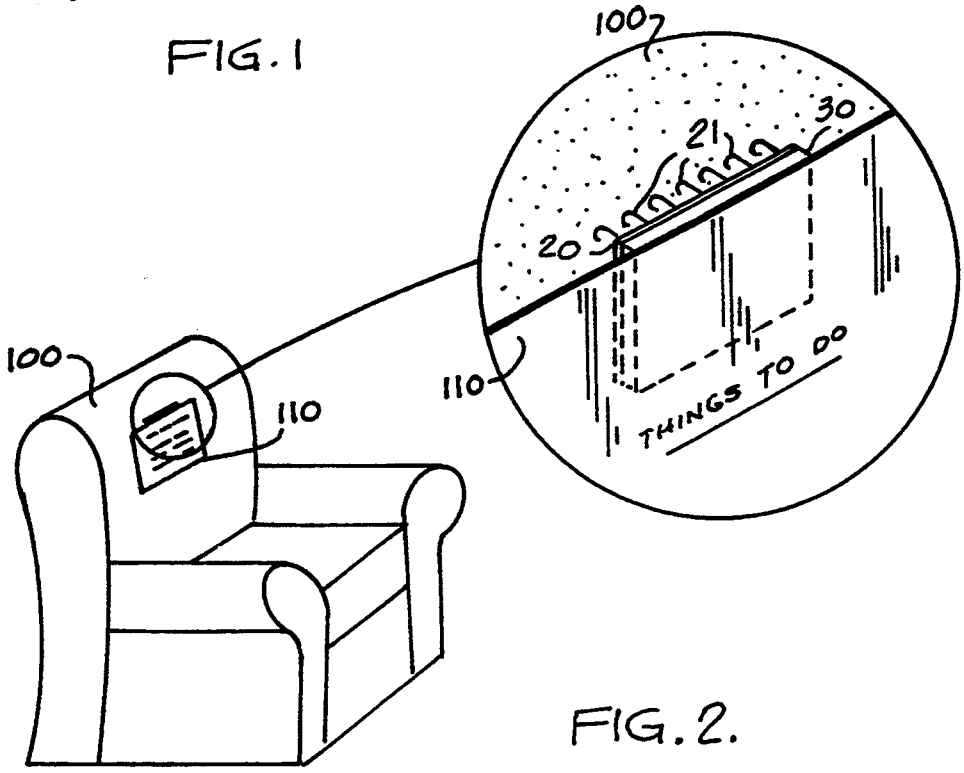
FIG. 2 is a perspective view of the first embodiment of the soft tack, shown attaching a paper sheet to an upholstered surface.
Figure 3:
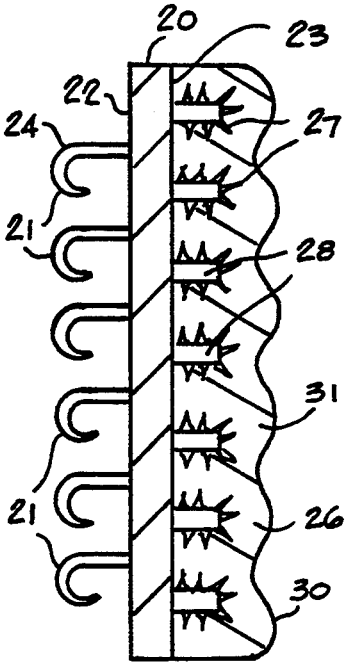
FIG. 3 is a side cross-sectional view of the first embodiment.

Referring to the figures, in its first embodiment, the soft tack of the present invention comprises a laminate structure of a layer of a sheet 20 with a plurality of hooked fibers 21 protruding from one side 22, the end 24 of the hooked fibers 21 curling back toward the sheet 20 in hook-like fashion. The sheet 20 further comprises on its side 23 opposite the hooked fibers 22 a textured surface 26, typically of small projecting rib fibers 27; and a structural matrix 30 formed by the small fibers 27 being completely embedded in a high tack adhesive 31 which is interfused in the textured surface 26.

Typically, adhesive when applied rests on top of a surface such as the sheet 20 providing at most only a chemical bond which may yield under load forces. The structural matrix 30 is provided to add a physical bond with its increased strength to any chemical bond formed between the adhesive and the sheet. Thus, the support limit of the soft tack becomes only the shear strength of the hook fibers 21 on the textured, coarse-woven fabric 100 and the shear strength of the device adhesive to a mating object 110, the device adherent being the structural matrix adhesive 31 in this first embodiment and the mild adhesive 56 in a second embodiment described below and shown in FIG. 4*c*.

To achieve the desired structural matrix 30, texture rib fibers 27 are typically arranged on rows of ribs 28 with the rib fibers 27 extending out from the ribs 28. To facilitate coating and penetration of adhesive into the rib fibers 27, mild heat is used to reduce the viscosity of the structural matrix adhesive 31, encouraging the adhesive 31 to flow in the matrix of rib fibers 27. Mild pressure may also be applied to complete the penetration of the adhesive.

Figure 4A:
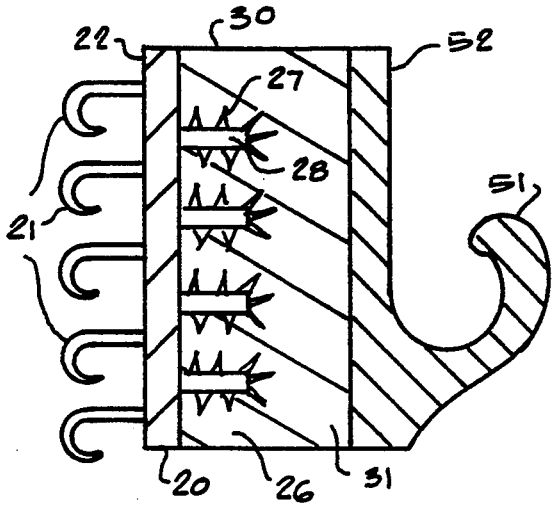
FIGS. 4*a*–4*c* are a set of 3 figures each showing a side cross-sectional view of a second embodiment of the soft tack with an attachment element.
Figure 4B:
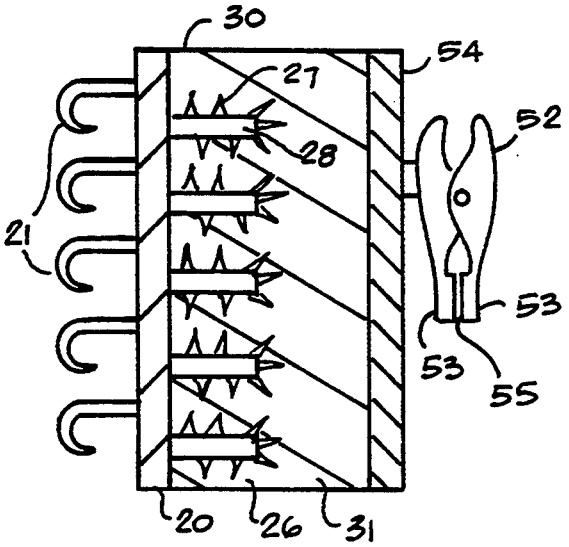

In a second embodiment of the present invention, the soft tack comprises the first embodiment in combination with an attachment element, shown in FIG. 4*a* to be a hook 51 on a hook plate 52, the structural adhesive 31 bonding the hook plate 52 to the structural matrix 30. In FIG. 4*b*, the attachment element is shown to be a conventional clasp 52. Typically, the clasp comprises two arms 52 each pivoting on a common rod intermediate the arms, one arm end attached to a plate 54, the arms being urged together on their ends opposite the attachment to the plate 54 by a spring bias (not shown) mounted on the common rod (not shown). The urged-together clasp ends may have flat matching opposing surfaces 55 for grasping an object therebetween without scarring the object.

Figure 4C:
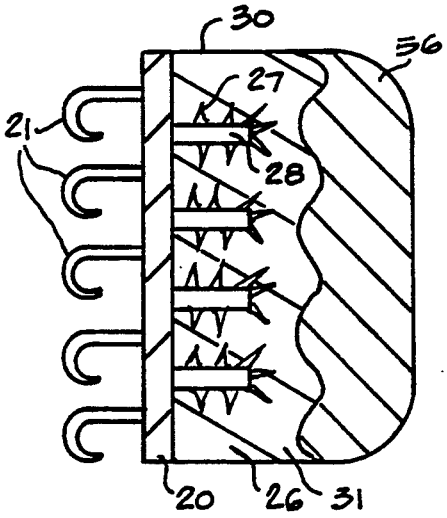

As shown in FIG. 4*c*, the attaching device may also be a mild adhesive 56 integral with the structural adhesive layer 31. The mild adhesive 56 has the property that it is sticky and therefore adheres to paper or plastic or the like but releases cleanly from such smooth surfaces on gentle urging without noticeable residue and without scarring, in the manner of 3M Post-It TM Notes release from paper.

When using the soft tack with mild adhesive, the soft tack is placed on a mating object 110, such as paper or a poster, with the mild adhesive 56 attaching to the object 110, and then the soft tack with the object is placed on an upholstered wall, or the like, with hooked fibers 21 thus superficially engaging the fibers of the coarsely-woven fabric 100 causing the soft tack and object to adhere to the fabric 100.

Figure 5:
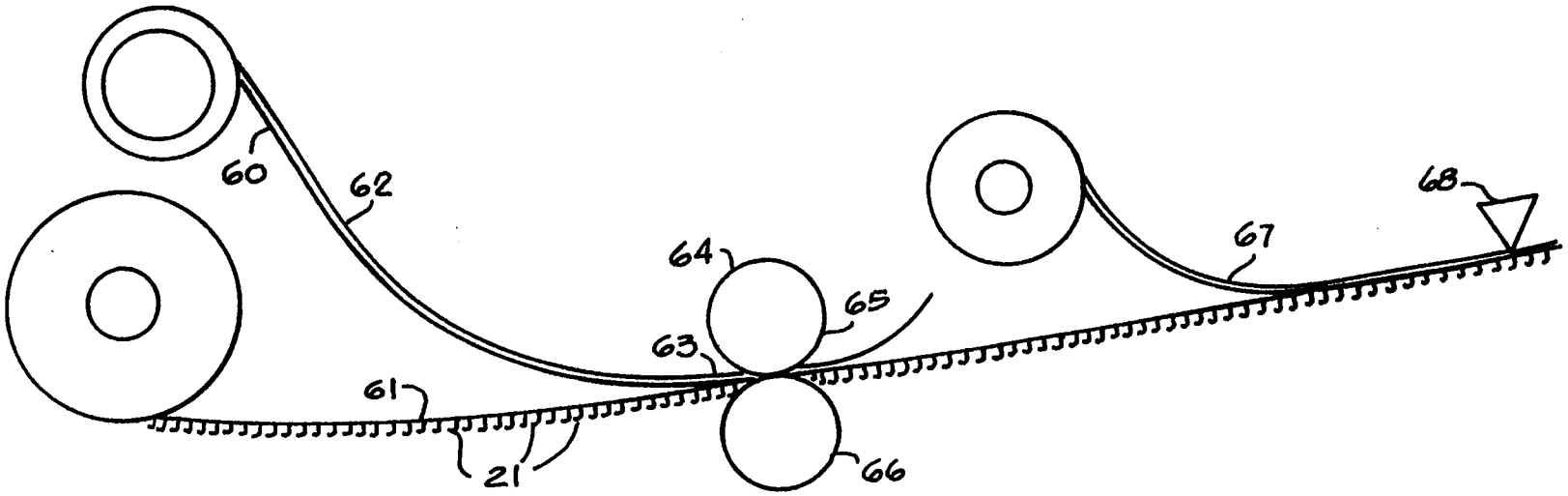
FIG. 5 picturally shows a typical process for manufacturing the soft tack with mild adhesive on its contact surface.

As shown in FIG. 5, the soft tack may be formed by first layering high tack adhesive 60 over the coarse texture of small fibers of the sheet 61 with a low-release adhesive liner 62 covering the adhesive 60 to form a laminar combination 63 of the adhesive between the sheet and the liner and then applying heat at a laminating station 64 to the laminar combination through the adhesive liner so that the adhesive flows into and interfuses with the small fibers of the sheet coarse texture without damaging the resilient fiber hooks on the sheet side opposite the adhesive. To better facilitate interfusing flow of adhesive into the sheet coarse texture, pressure may be applied with the heat. The pressure may be applied by placing the laminar combination 63 between two opposing pressure surfaces 65 and 66 with the pressure surface receiving the side of the laminar combination 63 having protruding hook fibers being a soft, adapting surface that receives the resilient hook fibers without damaging them. The low release liner 62 may then be removed and replaced with a tight release liner 67 and the construction then cut with cutter 68 to form soft tacks.

Having described the invention, what is claimed is

1. A tack laminate structure useful in facilitating removable attachment of an object to a soft coarsely-woven surface, comprising a sheet having on a first side a plurality of protruding resilient fibers with hooked ends and on a second side opposite the first side a coarse textured surface of small fibers, a structural matrix secured to the sheet second side, wherein the structural matrix comprises said coarse texture of small fibers completely embedded in a high tack adhesive with the adhesive interfused and solidified into the coarse texture of small fibers, and a clasp on the structural matrix comprising two arms each pivoting on a common rod intermediate the arms, one arm end attached to a plate, the arms being urged together on their ends opposite the attachment to the plate by a spring bias mounted on the common pivot rod.

2. The tack of claim 1 wherein the clasp further comprises opposing urged-together arm ends having flat opposing surfaces for grasping an object therebetween without scarring the object.

3. A tack laminate structure useful in facilitating removable attachment of an object to a soft, coarsely-woven surface, comprising a sheet having on a first side a plurality of protruding resilient fibers with hooked ends and on a second, side opposite the first side a coarse textured surface of small fibers, a structural matrix secured to the sheet second side, wherein the structural matrix comprises said coarse texture of small fibers completely embedded in a high tack adhesive with the adhesive interfused and solidified into the coarse texture of small fibers, and a plate having a traditional hook extending therefrom over which an object can be hung.

4. A reusable tack laminate structure useful in facilitating removable attachment of an object to a soft coarsely-woven surface, comprising a sheet having on a first side a plurality of protruding resilient fibers with hooked ends and on a second side opposite the first side a coarse textured surface of small fibers, a structural matrix secured to the sheet second side, wherein the structural matrix comprises said coarse texture of small fibers completely embedded in a high tack adhesive with the adhesive interfused and solidified into the coarse texture of small fibers, and an external adhesive contact surface of the structural matrix comprising a plurality of spaced-apart and extending contact areas so that the reduced contact of the structural matrix adhesive effectively forms a low tack adhesive surface to a mating object while retaining high tack adhesion in the structural matrix.

5. The invention of claim 4 further comprising a layer of mild adhesive over the external adhesive contact surface of the structural matrix so that the tack mildly adheres to an object and releases from the object without scarring the object upon gentle urging.

* * * * *